US006155996A

United States Patent [19]

Van Brunt et al.

[11] Patent Number: 6,155,996

[45] Date of Patent: Dec. 5, 2000

[54] DISPOSABLE PNEUMATIC CHEST COMPRESSION VEST

[75] Inventors: Nicholas P. Van Brunt, White Bear Lake; Donald J. Gagne, St. Paul, both of Minn.

[73] Assignee: American Biosystems, Inc., St. Paul, Minn.

[21] Appl. No.: 09/107,958

[22] Filed: Jun. 30, 1998

[51] Int. Cl.[7] ..... A61H 9/00; A61H 31/00

[52] U.S. Cl. ..... 601/41; 601/44; 601/152

[58] Field of Search ..... 601/41–44, 148, 601/149, 151, 152; 2/DIG. 3; 128/DIG. 20

[56] References Cited

U.S. PATENT DOCUMENTS

| | | | |
|---|---|---|---|
| 1,367,420 | 2/1921 | Munter . | |
| 2,338,535 | 1/1944 | Pfleumer . | |
| 3,266,070 | 8/1966 | O'Link . | |
| 3,577,977 | 5/1971 | Ritzinger et al. . | |
| 3,945,041 | 3/1976 | Rhee . | |
| 4,344,620 | 8/1982 | Debski . | |
| 4,453,538 | 6/1984 | Whitney . | |
| 4,483,336 | 11/1984 | Deitch . | |
| 4,561,853 | 12/1985 | Faulconer et al. . | |
| 4,637,074 | 1/1987 | Taheri . | |
| 4,646,366 | 3/1987 | Nishida et al. . | |
| 4,838,263 | 6/1989 | Warwick et al. | 601/44 |
| 5,277,194 | 1/1994 | Hosterman et al. | 601/41 X |
| 5,496,262 | 3/1996 | Johnson, Jr. et al. | 601/152 |
| 5,562,604 | 10/1996 | Yablon et al. | 601/148 |

FOREIGN PATENT DOCUMENTS

| | | |
|---|---|---|
| 2507064 | 12/1982 | France . |

*Primary Examiner*—Danton D. DeMille
*Attorney, Agent, or Firm*—David B. Edgeworth

[57] ABSTRACT

A disposable pneumatic chest compression vest includes an outer shell coupled with an inner bladder. Both the outer shell and inner bladder are made from materials that emit relatively low emissions when burned. Also, the outer shell is made from a flexible, non-stretch material that provides good chest compressions. The vest is easy to position about a patient and is quickly closed by adhesive strip or other closure. When no longer needed, the vest is easily removed and disposed of as medical waste.

5 Claims, 1 Drawing Sheet

DISPOSABLE PNEUMATIC CHEST COMPRESSION VEST

BACKGROUND OF THE INVENTION

The present invention relates to a medical device, namely, an apparatus for delivering compressions to the chest of a patient for treatment and diagnostic purposes.

It has been recognized that applying pneumatic pressure to the thoracic cavity or chest wall of a patient has both diagnostic and treatment applications. For example, chest compressions may be used for airway mucus mobilization in the evaluation and treatment of cystic fibrosis (see, e.g., U.S. Pat. No. 5,453,081, 5,056,505, and 4,838,263), emphysema, asthma, and chronic bronchitis. Chest compressions may be useful for generating mucus samples suitable for detecting lung cancer and other breathing-related conditions. Also, pneumatic pressure may be used in breathing assistance, measuring the concentration of exhaled gases, and determining the condition of airways in patients with respiratory problems. Further, pneumatic chest compression may improve the efficiency, speed, and/or depth of deposition of aerosol medications used in respiratory treatment.

Typically, a bladder or other type of air-receiving chamber is positioned about the thorax or chest of a patient. An airflow generating system is coupled with the bladder by a hose or other connector. The airflow generating system selectively controls the air pressure in the bladder to provide the desired compression(s) of the patient's chest. In prior art systems, the bladder is typically contained within an outer shell in the form of a vest. The vest design positions and holds the bladder in place during the compressions, and is relatively easy for a patient to get in and out of The typical chest compression vest is designed for long-term use by a single patient. This type of vest allows for limited adjustment, but is generally fitted for a single user. For example, a cystic fibrosis patient may receive daily therapy of chest compressions delivered by a system as described above. Such a system is available from American Biosystems, Inc., St. Paul, Minn., assignee of the present invention. The single-user chest compression vest includes a heavy-duty outer shell made from nylon or other durable fabric. The inner bladder is made from rubber or other suitable material designed to withstand repeated use. In other words, the vest is made from sturdy and durable materials to meet the needs of long-term use.

However, clinical applications for chest compression vests raise different design criteria. In clinical applications, e.g., a respiratory clinic, numerous patients may each need a vest for diagnostic tests and for treatment. Also, in the clinical environment, the vest will likely have some expelled mucus on its outer surface, which may include contagious disease. Consequently, a vest for the clinical environment should be either repeatedly sterilizable or economically viable as a single use product. The long-term vest described above is neither. It cannot be repeatedly sterilized and, due the heavy-duty materials and construction, it is too expensive for single use.

Additionally, once a vest has been used by a patient it should be disposed of as a medical waste product due to the expelled mucus on the vest. Medical waste is commonly burned to destroy any disease or contagious organisms and to reduce the waste to a small size. The vest described above is typically made from materials that do not easily or cleanly burn (e.g., nylon and rubber). Also, these materials may produce harmful particulate or gas emissions when burned.

Consequently, there is a need for a chest compression vest suitable for clinical applications. The vest should meet the unique needs of the clinical environment as described above.

SUMMARY OF THE INVENTION

The present invention is directed toward a disposable pneumatic chest compression vest. The vest includes a non-stretch, flexible shell having an outer surface and an inner surface, and a first end and a second end. Coupling means are provided for selectively coupling the first and second ends. An air-receiving bladder is operably coupled with the inner surface of the shell. In one embodiment, the bladder is coupled with the shell by adhesive strips. The shell and bladder comprise materials that have low emissions when burned. The vest may additionally include a plurality of suspenders straps, operably coupled with the shell, and an air-receiving connection.

In one embodiment, the shell comprises polystyrene sheet material about 0.020 inches in thickness. In another embodiment, the coupling means comprises an adhesive strip on the first end of the shell. In another embodiment, the bladder comprises 0.002-inch polyethylene tubing material.

The present invention provides several advantages. The invention can be efficiently used as a single-user, disposable product. Due to its constituent materials and design, it is relatively low-cost, easy to store, easy to dispose of (with minimal combustion emissions), and easy to fit about patients of different size and shape. Further, due to the non-stretch outer shell, the vest efficiently delivers pneumatic compressions to the patient.

DETAILED DESCRIPTION OF THE EMBODIMENTS

Figure 2:
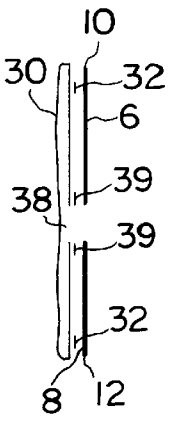
FIG. 2 is a side, cut-away view of a pneumatic chest compression vest.
Figure 1:
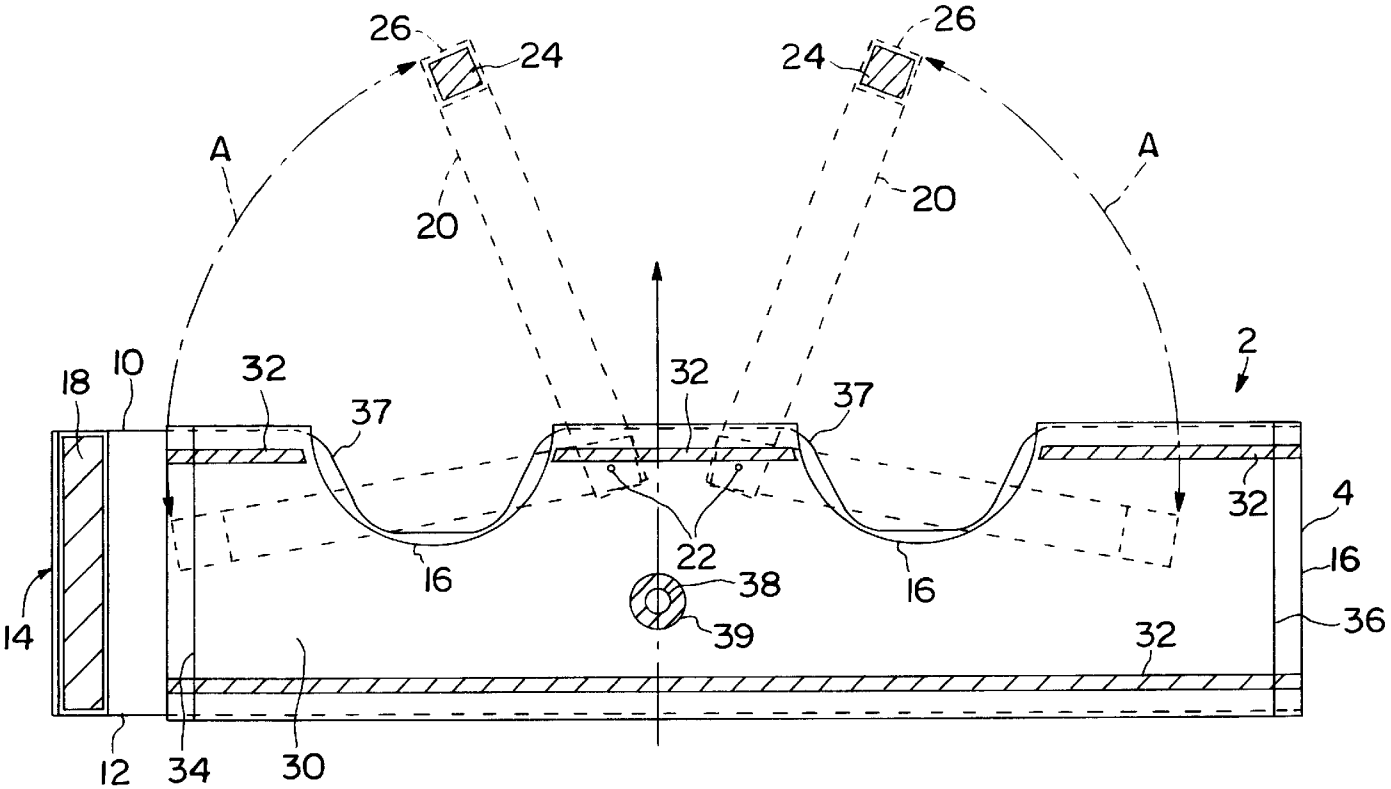
FIG. 1 is a plan view of a pneumatic chest compression vest.

FIGS. 1 shows a disposable pneumatic chest compression vest 2 lying flat, a position in which the vest can be efficiently stored. Vest 2 includes an outer shell 4, made from a flexible, non-stretch material. In one embodiment, shell 4 is made from 0.020-inch polystyrene sheet. The polystyrene sheet not only provides the desired operational characteristics of being a light-weight, thin, non-stretch material; it also may be burned as medical waste, producing nontoxic glses and little, if any, particulate matter. Other materials having these characteristics may also be used.

In the flat position, shell 4 is generally rectangular with an outer surface 6, an inner surface 8, a top) edge 10, a bottom edge 12, and opposed ends 14, 16. Top edge 10 includes concave surfaces 16, which define arm cut-outs. An adhesive strip 18 is positioned on inner surface 8 adjacent first end 14 for coupling ends 14, 16, as described below. Other coupling mechanisms may also be used, including hook and loop type systems. In one embodiment, shell 4 is about 48 inches from end 14 to end 16, and about 11 inches from top edge 10 to bottom edge 12. Also, several sizes of vest may be made with each size corresponding to a general category, e.g., large, medium, small, and child.

Suspender straps 20 are coupled with shell 4 by pins 22, or other suitable connectors, so that straps 20 can pivot along arc A, as shown in FIG. 1. Suspender straps 20 are made from the same or similar materials as shell 4. The length of straps 20 is selected so that the straps may be folded over the shoulder of the patient as described below. The width of straps 20 is selected so that the straps provide suspension support of the vest without digging into the patient's shoulders. In one embodiment the straps are about 18 inches long and about 2 inches wide. Adhesive patches 24 are positioned on distal ends 26 of straps 20 for fixing the straps in place once the vest is fitted about the patient.

Generally air-tight bladder 30 is coupled with inner surface 8 of shell 4. In one embodiment, bladder 30 is made from 0.002 inch polyethylene tubing. Again, polyethylene provides not only desired operational characteristics, but also may be burned as medical waste with no toxic gas emissions and little particulate matter. Other materials having these characteristics may also be used. The tubing material is cut to the desired length and is coupled with shell 4 by adhesive strips 32. Other coupling systems may also be used, including glue. Also, the tubing material is cut to conform to concave surfaces 16, forming the arm cut-outs. The tubing is made generally air tight by welding the two opposed ends 34, 36 and the arm cut out areas 37 using any plastic welding processes.

Air-receiving connection 38 extends through outer shell 4 and into bladder 30. A generally circular adhesive patch 39 couples shell 4 and bladder 30 adjacent connection 38 so that bladder 30 remains air-tight. The size of connection 38 is selected to receive a fitting or hose end that couples vest 2 with an airflow generating system.

As described above, vest 2 is typically stored as a flat sheet. Also, the vest could be stored as a rolled-up tube. In order to use vest 2, it is positioned about a patient's chest with bladder 30 adjacent the chest and shell 4 outward therefrom. First end 14 overlaps second end 16 and ends 14, 16 are moved relative to each other for the desired fit about the chest. Concave surfaces 16 are positioned to allow the vest to slide up under the patient's arms so that the vest is suitably high on the patient's chest and not about the abdomen. Adhesive strip 18 is then placed in contact with outer surface 6 fixing vest 2 about the patient's chest. Flexible outer shell 4 is now in a generally cylindrical shape.

Suspender straps 20 are placed over the patients shoulders, from front to back, and adhesive patches 24 are fixed to outer surface 6 of shell 4 in a location providing comfort and support for the patient. Once straps 20 are fixed, vest 2 should be fixed about the patient's chest and unable to slide downward toward the abdomen.

Bladder 30 is then coupled with an airflow generating system via connection 38. Bladder is flexible and, as it receives air, the inner surface conforms to the complex contoured surface of the patient's chest. The outer surface of bladder 30 is in contact with cylindrical, non-stretch, outer shell 4. Consequently, as air pulses are delivered to bladder 30, the pulses are efficiently transferred to the patient due to the stable cylindrical structure and non-stretch characteristics of outer shell 4. Further, this structure may be more efficient in delivering air pulses than the long-term single-user vests described above. It is believed that the reason is that the outer shell 4 of the present invention is more stable and stretch-resistant than the outer shell of prior art vests.

The disposable chest compression vest of the present invention is suitable for typical pressure requirements, i.e., about 0.5 PSI to about 1 PSI. Also, the vest should operate for at least about thirty to forty-five minutes when used in an oscillatory chest compression application. The vest may last longer in other, less stringent, applications.

Other embodiments are within the scope of the following claims.

We claim the following:

1. An apparatus, comprising:

a non-stretch, flexible, polystyrene sheet shell, the shell having an outer surface and an inner surface, and a first end and a second end;

an adhesive strip on the first end of the shell for selectively coupling the first and second ends forming a generally cylindrical shape; and a generally air-tight bladder for receiving air pulses, the bladder operably coupled with the inner surface of the shell, wherein the bladder comprises polyethylene tubing material, wherein the polystyrene sheet is about 0.020 inches in thickness.

2. The apparatus of claim 1, wherein the bladder comprises 0.002 inch polyethylene tubing material.

3. The apparatus of claim 1, further comprising a plurality of polystyrene suspenders straps having first and second ends, wherein the first ends are pivotally coupled with the shell and adhesive strips are positioned adjacent the second ends.

4. The apparatus of claim 1, further comprising an air-receiving connection.

5. An apparatus, comprising:

a non-stretch, flexible, polystyrene sheet shell. the shell having an outer surface and an inner surface, and a first end and a second end;

an adhesive strip on the first end of the shell for selectively coupling the first and second ends forming a generally cylindrical shape; and a generally air-tight bladder for receiving air pulses, the bladder operably coupled with the inner surface of the shell, wherein the bladder comprises polyethylene tubing material, wherein the bladder is coupled with the shell by adhesive strips.

* * * * *